US006234622B1

(12) United States Patent
Liu et al.

(10) Patent No.: US 6,234,622 B1
(45) **Date of Patent: *May 22, 2001**

(54) INK DELIVERY SYSTEM THAT UTILIZES A SEPARATE INSERTABLE FILTER CARRIER

(75) Inventors: Kan Liu; Joe R. Pietrzyk, both of San Diego, CA (US)

(73) Assignee: Hewlett-Packard Company, Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/846,970

(22) Filed: Apr. 30, 1997

(51) Int. Cl.[7] ..... B41J 2/175
(52) U.S. Cl. ..... 347/93
(58) Field of Search ..... 347/93, 85, 86, 347/87, 92

(56) References Cited

U.S. PATENT DOCUMENTS

| | | | | |
|---|---|---|---|---|
| 4,015,272 | * | 3/1977 | Yamamori et al. | 347/68 |
| 4,313,684 | | 2/1982 | Tazaki | 400/322 |
| 4,394,669 | | 7/1983 | Ozawa et al. | 347/86 |
| 4,490,728 | | 12/1984 | Vaught | 347/60 |
| 5,278,584 | | 1/1994 | Keefe | 347/63 |
| 5,367,328 | * | 11/1994 | Erickson | 347/7 |
| 5,376,272 | * | 12/1994 | Spearman | 210/463 |
| 5,408,746 | | 4/1995 | Thoman | 29/890.1 |
| 5,815,185 | * | 9/1998 | Pietrzyk | 347/92 |

FOREIGN PATENT DOCUMENTS

| | | | |
|---|---|---|---|
| 0675000A2 | 10/1995 | (EP) | B41J/2/175 |
| 0771664A1 | 5/1997 | (EP) | B41J/2/175 |
| 0832748A2 | 4/1998 | (EP) | B41J/2/175 |

OTHER PUBLICATIONS

Hewlett–Packard Journal, vol. 36, No. 5 (May 1985).

Hewlett–Packard Journal, vol. 39, No. 4 (Aug. 1988).

Hewlett–Packard Journal, vol. 39, No. 5 (Oct. 1988).

Hewlett–Packard Journal, vol. 43, No. 4 (Aug. 1992).

Hewlett–Packard Journal, vol. 43, No. 6 (Dec. 1992).

Hewlett–Packard Journal, vol. 45, No. 1 (Feb. 1994).

Durbeck, R.C. and S. Sherr, Eds., "Inkjet Devices," Chapter 13 of Output Hardcopy Devices, Academic Press, 1988.

U.S. application Ser. No. 08/706,121, filed Aug. 30, 1996, Pawlowski, Jr.

* cited by examiner

*Primary Examiner*—N. Le
*Assistant Examiner*—Michael Nghiem
(74) *Attorney, Agent, or Firm*—Dennis G. Stenstrom

(57) ABSTRACT

Described is an ink delivery system is that utilizes a filter carrier to simplify the process of attaching the filter. The filter carrier is an element that has a conduit that is substantially surrounded by a filter attach surface. The filter is attached to this surface, such that substantially all fluid passing through the conduit is filtered. The filter carrier is installed into a housing upon which a printhead is mounted. The filter then divides the ink delivery portion of the housing into upstream and downstream sections such that ink flows from the upstream portion through the filter to the downstream portion and to the printhead. The separation of the filter sing from the cartridge housing provides more freedom of material selection for both the cartridge housing and a good heat staking material for the filter carrier. The separation also greatly simplifies the molding of the rigid cartridge housing. Also, the filter staking process is greatly simplified when it is performed external to the cartridge housing. Also provided is the ability to have an adjustable air warehouse volume to accommodate various out-gassing rates of different print usages cartridge usages.

10 Claims, 14 Drawing Sheets

INK DELIVERY SYSTEM THAT UTILIZES A SEPARATE INSERTABLE FILTER CARRIER

CROSS-REFERENCE TO RELATED APPLICATIONS

This application is related to U.S. patent application Ser. No. 08/748,726, filed Nov. 13, 1996, now U.S. Pat. No. 5,815,185 entitled "Ink Flow Heat Exchanger for Inkjet Printhead" and U.S. patent application Ser. No. 08/706,121, filed Aug. 30, 1996, now U.S. Pat. No. 5,966,155 entitled "Inkjet Printing System with Off-Axis Ink Supply Having Ink Path Which Does Not Extend above Print Cartridge." The foregoing commonly assigned patent applications are herein incorporated by reference.

FIELD OF THE INVENTION

This invention relates to inkjet printers and, more particularly, to an inkjet printer having a scanning printhead with an ink delivery system is provided that utilizes a filter carrier to simplify the process of attaching the filter.

BACKGROUND OF THE INVENTION

Thermal inkjet hardcopy devices such as printers, graphics plotters, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 February 1994)], incorporated herein by reference. Inlet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes "dot locations", "dot positions", or pixels". Thus, the printing operation can be viewed as the filing of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the resistor elements. When electric printing pulses heat the inkjet firing chamber resistor, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied times the distance between nozzle centers. After each such completed movement or swath the medium is moved forward the width of the swath, and the ink cartridge begins the next swath. By proper selection and timing of the signals, the desired print is obtained on the medium.

A concern with inkjet printing is the sufficiency of ink flow to the paper or other print media. Print quality is a function of ink flow through the printhead. Too little ink on the paper or other media to be printed upon produces faded and hard-to-read documents.

In an inkjet printhead ink is fed from an ink reservoir integral to the printhead or an "off-axis" ink reservoir which feeds ink to the printhead via tubes connecting the printhead and reservoir. Ink is then fed to the various vaporization chambers either through an elongated hole formed in the center of the bottom of the substrate, "center feed", or around the outer edges of the substrate, "edge feed". In center feed the ink then flows through a central slot in the substrate into a central manifold area formed in a barrier layer between the substrate and a nozzle member, then into a plurality of ink channels, and finally into the various vaporization chambers. In edge feed ink from the ink reservoir flows around the outer edges of the substrate into the ink channels and finally into the vaporization chambers. In either center feed or edge feed, the flow path from the ink reservoir and the manifold inherently provides restrictions on ink flow to the firing chambers.

Air and other gas bubbles and particulate matter can cause major problems in ink delivery systems. Ink delivery systems are capable of releasing gasses and generating bubbles, thereby causing systems to get clogged and degraded by bubbles. In the design of a good ink delivery system, it is important that techniques for eliminating or reducing bubble problems be considered.

Inkjet printheads are typically attached to a housing or body pf a print cartridge which contains an ink reservoir. The housing has a conduit for supplying ink from the ink reservoir to the printhead. Inkjet printheads are very sensitive to particulate contamination. To deal with this problem, a filter is typically disposed between the reservoir of ink and the printhead. A filter is attached to the inside of the housing, separating the ink conduit of the housing into two regions—one upstream and one downstream of the filter. This type of design has a number of drawbacks.

First, the housing material tends to be selected for structural rigidity and high heat deflection. Fillers (such as glass fibers) are typically included to enhance these properties. Such materials tend to be difficult surfaces to which to attach a filter and effect a complete seal around the perimeter of the filter. If the seal is not complete, bubbles or particulates may slip past the filter and block the ink channels or nozzles.

One method to improve upon this is to provide a second plastic material by insert molding to rigid outer housing. However insert molding is very expensive and the outer rigid housing must be adapted to be compatible with insert molding. The separation the filter staking from the cartridge housing would provide more freedom of material selection for both the cartridge housing and a good heat staking material for the filter carrier. Moreover, the filter staking process is greatly simplified when it can be performed external to the cartridge housing is done outside a pen body. All of these difficulties are even further compounded by the advent of a new design that provides a jet impinging flow of ink to cool the printhead. This design makes the molding of the rigid housing very difficult.

Another problem that occurs during the life of the print element is air out gassing. Air builds up between the filter and the printhead during operation of the printhead. For printers that have a high use model, it would be preferable to have a larger volume between the filter and the printhead for the storage of air. For low use rate printers, this volume would be reduced.

Accordingly, there is a need to provide a way to reduce dependency of the filter attach properties upon the selection of exterior housing properties without adding a costly insertion molding process. Further, there is a need to provide a housing and filter design that makes the jet impinging flow design easier to mold. There is also a need for a way to provide a variable volume for the storage of out gassed air for the same print cartridge housing.

SUMMARY OF THE INVENTION

An ink delivery system is provided that utilizes a filter carrier to simplify the process of attaching the filter. The filter carrier is an element that has a conduit therethrough that is substantially surrounded by a filter attach surface. The filter is attached to this surface, such that substantially all fluid passing through the conduit is filtered. The filter carrier is installed into a housing upon which a printhead is mounted. The filter then divides the ink conduit of the housing into upstream and downstream sections such that ink flows from the upstream portion through the filter to the downstream portion and to the printhead. The separation of the filter staking from the cartridge housing provides more freedom of material selection for both the cartridge housing and a good heat staking material for the filter carrier. The separation also greatly simplifies the molding of the rigid cartridge housing. Also, the filter staking process is greatly simplified when it is performed external to the cartridge housing. The present invention also provides the ability to have an adjustable air warehouse volume to accommodate various out-gassing rates of different print usages cartridge usages.

DETAILED DESCRIPTION OF THE PREFERRED EMBODIMENTS

Figure 1:
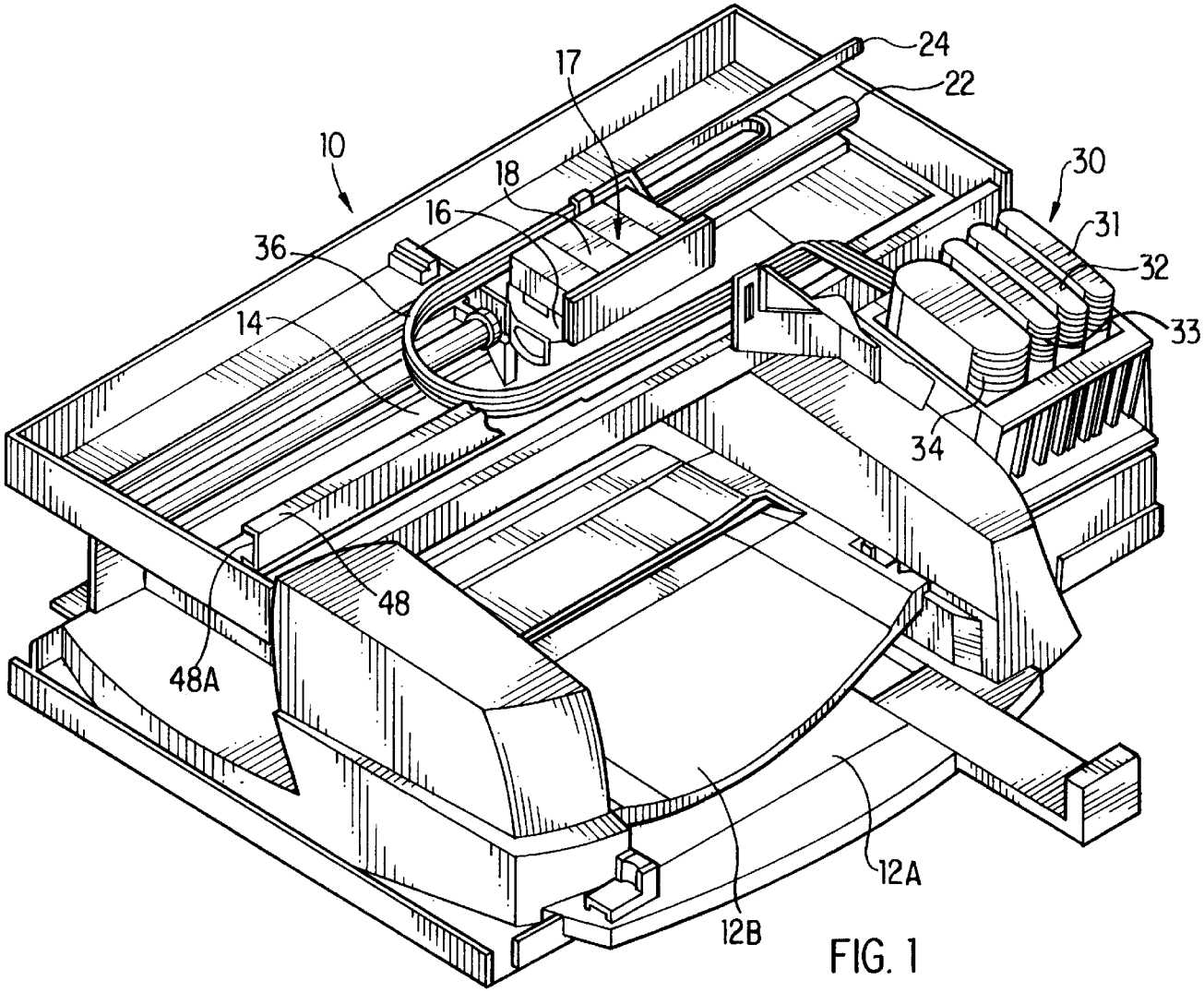
FIG. 1 is a perspective view of one embodiment of an inkjet printer incorporating the present invention.

While the filter carrier assembly of the present invention will be described below in the context of an off-axis printer having an external ink source, it should be apparent that the present invention is equally useful in an inkjet printer which uses inkjet print cartridges having an ink reservoir integral with the print cartridge. FIG. 1 is a perspective view of one embodiment of an inkjet printer 10 suitable for utilizing the filter carrier assembly of the present invention, with its cover removed. Generally, printer 10 includes a tray 12A for holding virgin paper. When a printing operation is initiated, a sheet of paper from tray 12A is fed into printer 10 using a sheet feeder, then brought around in a U direction to now travel in the opposite direction toward tray 12B. The sheet is stopped in a print zone 14, and a scanning carriage 16, supporting one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may be conventional and generally includes a slide rod 22, along which carriage 16 slides, a flexible circuit (not shown in FIG. 1) for transmitting electrical signals from the printer's microprocesser to the carriage 16 and print cartridges 18 and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

The features of inkjet printer 10 include an ink delivery system for providing ink to the print cartridges 18 and ultimately to the ink ejection chambers in the printheads from an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31–34 to the print cartridges 18.

Figure 3:
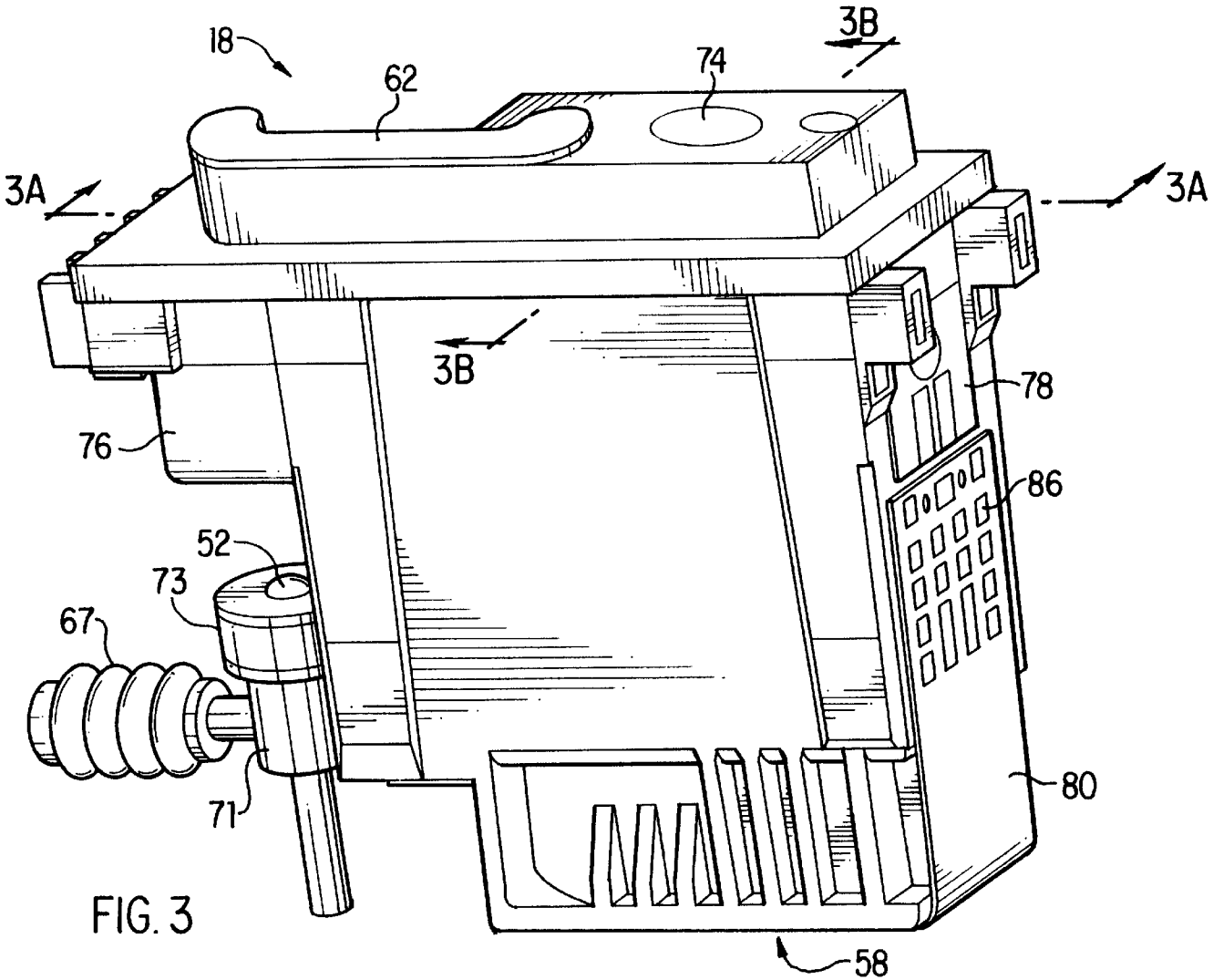
FIG. 3 is a perspective view of a single print cartridge and also showing the fluid interconnect portion of the carriage.

FIG. 3 is a perspective view of one embodiment of a print cartridge 18. A shroud 76 (also shown in FIG. 10) surrounds needle 60 (obscured by shroud 76) to prevent inadvertent contact with needle 60 and also to help align septum 52 (FIG. 10) with needle 60 when installing print cartridge 18 in carriage 16. A flexible tape 80 containing contact pads 86 leading to the printhead substrate is secured to print cartridge 18. These contact pads 86 align with and electrically contact electrodes 49 (FIG. 3A) on carriage 16. Preferably, the electrodes on carriage 16 are resiliently biased toward print cartridge 18 to ensure a reliable contact. Such carriage electrodes are found in U.S. Pat. No. 5,408,746, entitled Datum Formation for Improved Alignment of Multiple Nozzle Members in a Printer, by Jeffrey Thoman et al., assigned to the present assignee and incorporated herein by reference.

The printhead nozzle array is at location 58. An integrated circuit chip 78 provides feedback to the printer regarding certain parameters of print cartridge 18.

Figure 4:
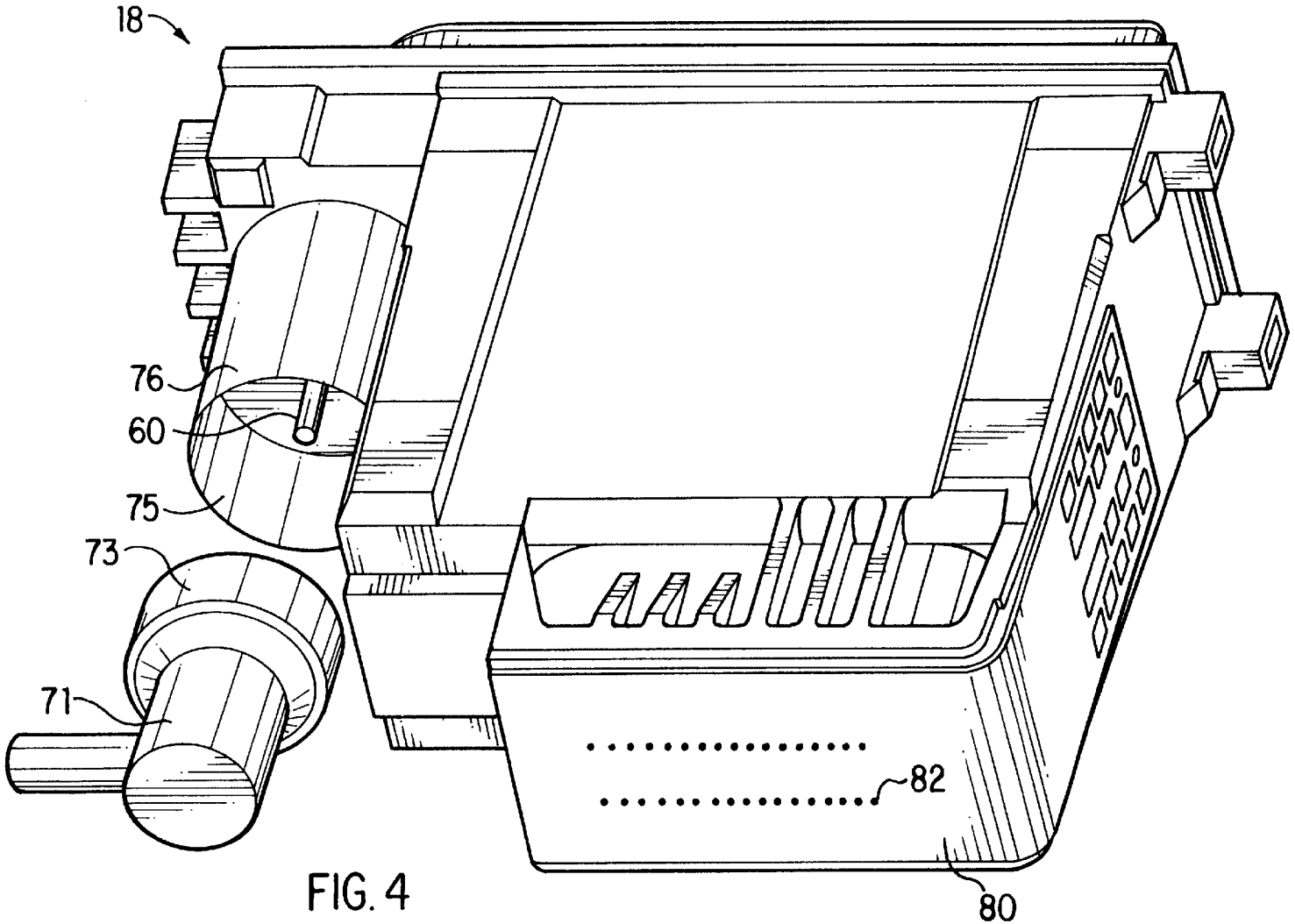
FIG. 4 is another perspective view a single print cartridge and the fluid interconnect portion of the carriage.

FIG. 4 illustrates the bottom side of print cartridge 18. Two parallel rows of offset nozzles 82 are shown laser ablated through tape 80.

Figure 5:
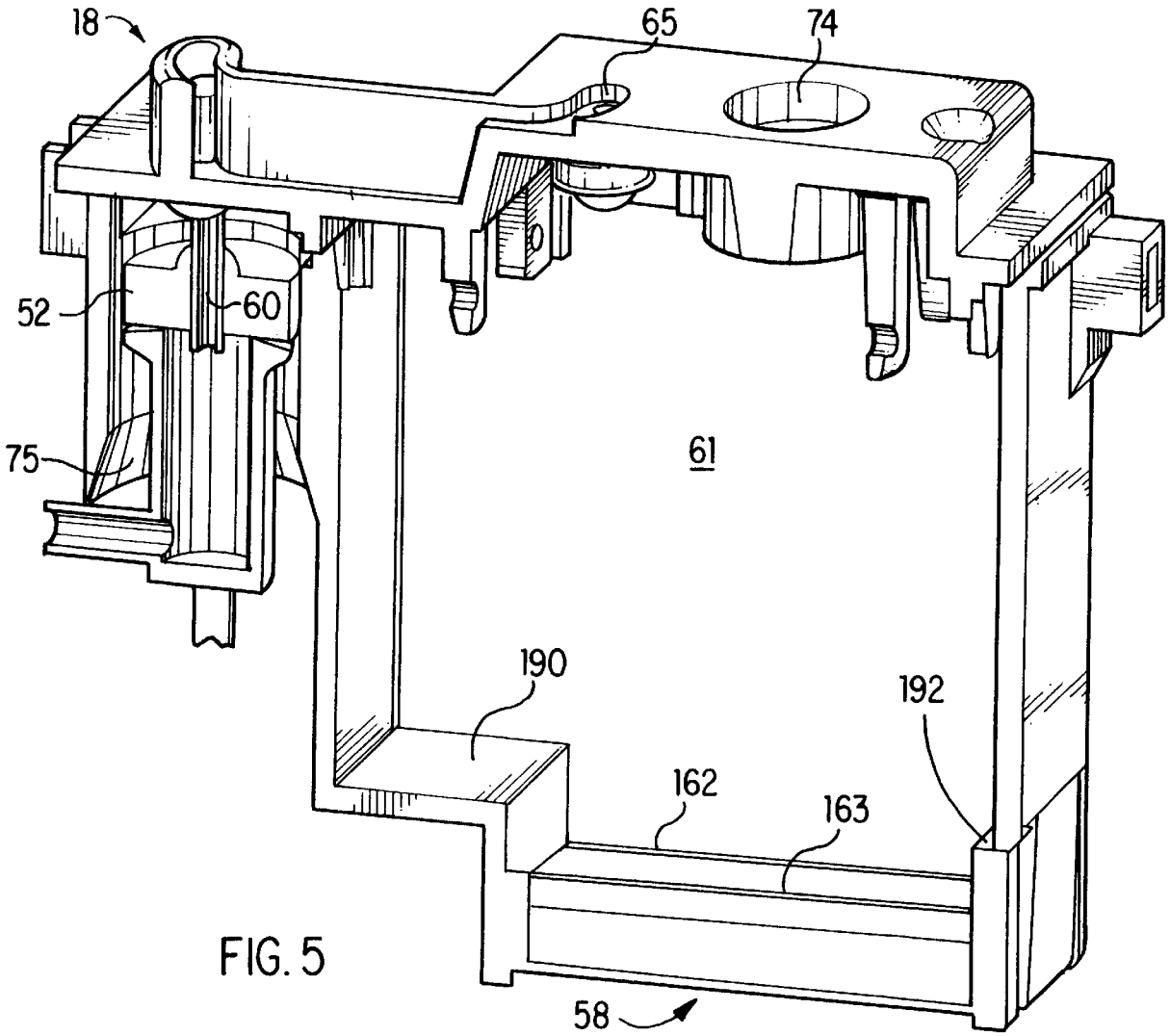
FIG. 5 is a cross-sectional, perspective view along line A—A of the print cartridge of FIG. 3 shown connected to the fluid interconnect on the carriage.

FIG. 5 is a cross-sectional view of print cartridge 18, without tape 80, taken along line 5A—5A in FIG. 3. Shroud 76 is shown having an inner conical or tapered portion 75 to receive septum 52 and center septum 52 with respect to needle 60. In an alternative embodiment, needle 60 is part of a separate subassembly, and shroud 76 is a separate subassembly, for manufacturing ease.

A regulator valve (not shown) within print cartridges 18 regulates pressure by opening and closing an inlet hole 65 to ink chamber 61 internal to print cartridges 18. For a description of the design and operation of the regulator see U.S. patent application Ser. No. 08/706,121, filed Aug. 30, 1996, now U.S. Pat. No. 5,966,155 entitled "Inkjet Printing System with Off-Axis Ink Supply Having Ink Path Which Does Not Extend above Print Cartridge," which is herein incorporated by reference.

When the regulator valve is opened, a hollow needle 60 is in fluid communication with an ink chamber 61 internal to the cartridge 18. The needle 60 extends through a self-sealing hole formed in through the center of the septum 52. The hole is automatically sealed by the resiliency of the rubber septum 52 when the needle is removed. A plastic conduit 62 leads from the needle 60 to chamber 61 via hole 65. The conduit may be glued, heat-staked, ultrasonically welded or otherwise secured to the print cartridge body. The conduit may also be integral to the print cartridge body. Surfaces 190, 192 support the filter carrier 200 which will be described in detail below with respect to FIGS. 9–13.

A septum elbow 71 routes ink from the manifold 66 to the septum 52, and supports the septum. The septum is affixed to the elbow using a crimp cap 73. The coupler 67 in this exemplary embodiment is a flexible bellows for allowing a degree of x, y and z movement of the septum 52 when the needle 60 is inserted into the septum to minimize the load on the needle and ensure a fluid-tight and air-tight seal around the needle. The bellows may be formed of butyl rubber or other flexible material having low vapor and air transmission properties. Alternatively, the bellows can be replaced with a U-shaped or circular flexible tube. A spring 70 urges the septum 52 upwardly, allowing the septum to take up z tolerances, minimizes the load on the needle 60 and ensures a tight seal around the needle 60.

The print cartridges and ink supply connections described above are down-connect types where the ink connection is made when pressing the print cartridge down into the carriage. This enables a resulting printer to have a very low profile since the ink path does not extend above the print cartridge. In the embodiments shown having the needle extending from the print cartridge, the needle may be replaced with a septum, and the septum on the scanning carriage replaced with a hollow needle. When in use in the printer 10, the print cartridges 18 are in fluid communication with an off carriage ink supply 31–34 that is releasably mounted in an ink supply station 30. Without this fluid communication, the new off-axis design print cartridges have very little internal ink capacity in their reservoirs and these print cartridges 18 can expel only approximately 1 cc of ink.

Figure 6:
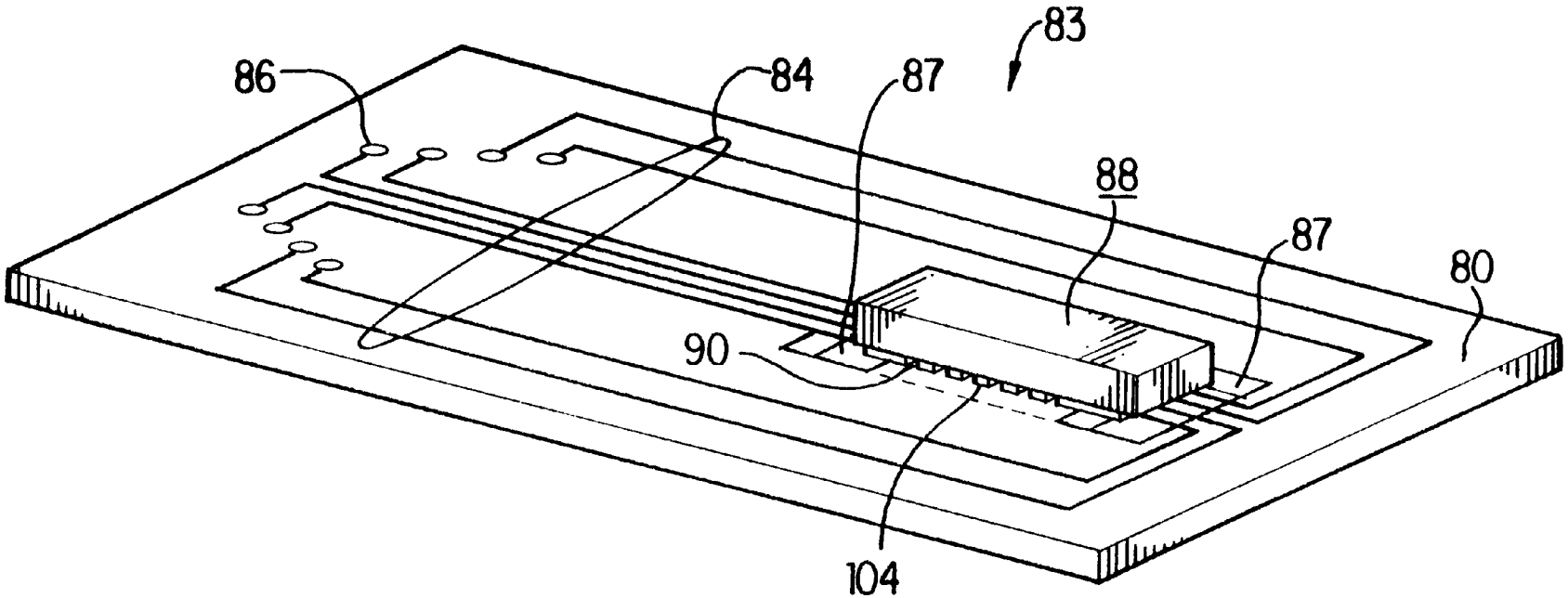
FIG. 6 is a perspective view of the back side of the printhead assembly.

Referring to FIGS. 4 and 6, printhead assembly 83 is preferably a flexible polymer tape 80 having nozzles 82 formed therein by laser ablation. Conductors 84 are formed on the back of tape 80 and terminate in contact pads 86 for contacting electrodes on carriage 16. The other ends of conductors 84 are bonded through windows 87 to terminals of a substrate 88 on which are formed the various ink ejection chambers and ink ejection elements. The ink ejection elements may be heater resistors or piezoelectric elements.

A demultiplexer on substrate 88 demultiplexes the incoming electrical signals applied to contact pads 86 and selectively energizes the various ink ejection elements to eject droplets of ink from nozzles 82 as printhead 58 scans across the print zone. In one embodiment, the dots per inch (dpi) resolution is 300 dpi, and there are 300 nozzles 82. In another embodiment, at least the black ink cartridge prints at a resolution of 600 dpi.

The printhead assembly may be similar to that described in U.S. Pat. No. 5,278,584, by Brian Keefe, et al., entitled "Ink Delivery System for an Inkjet Printhead," assigned to the present assignee and incorporated herein by reference. In such a printhead assembly, ink within print cartridge 18 flows around the edges of the rectangular substrate 88 and into ink channels 90 leading to each of the ink ejection chambers.

Figure 7:
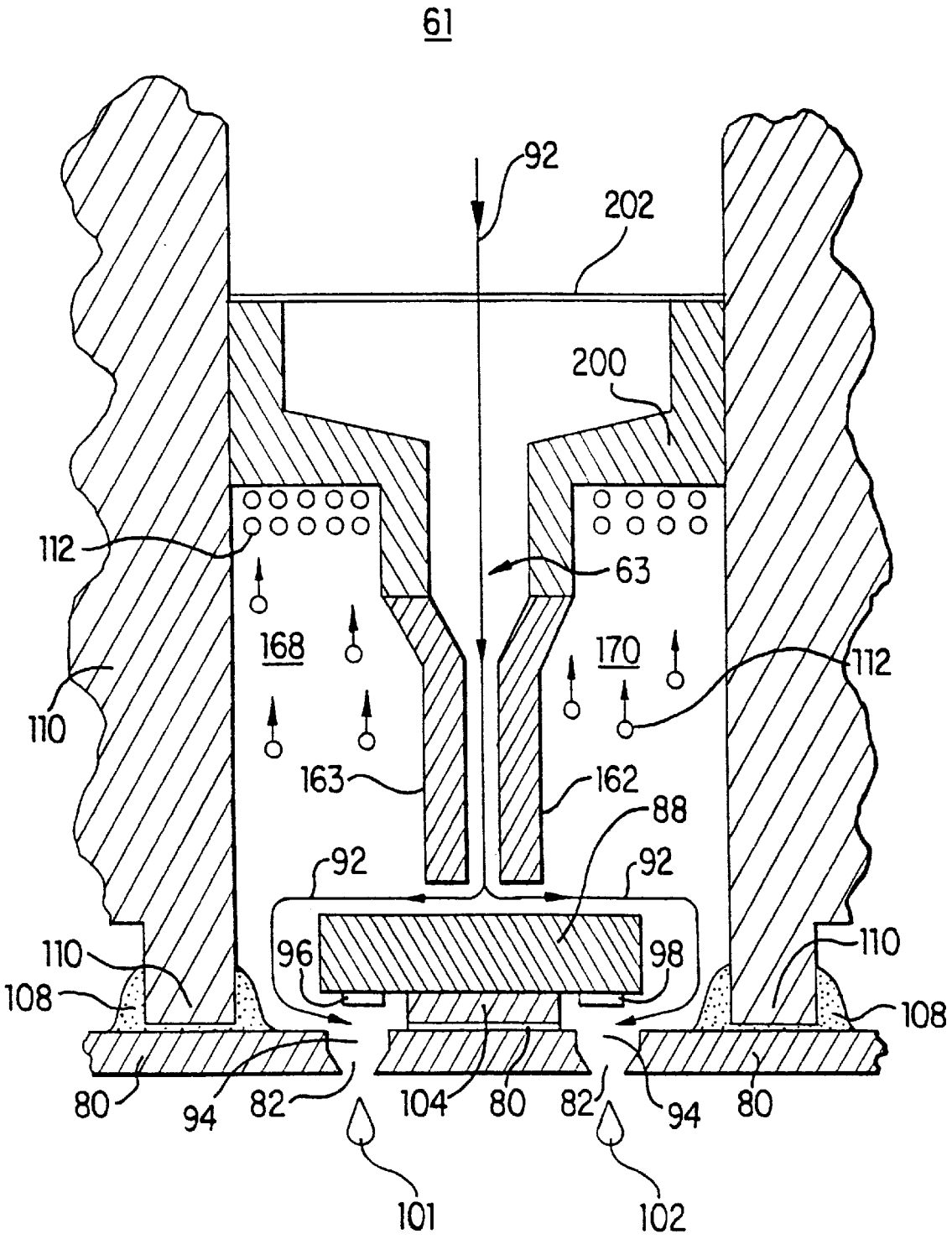
FIG. 7 is a cross-sectional view along line B—B of FIG. 3 illustrating the portion of the printhead assembly showing the flow of ink to the ink ejection chambers in the printhead.

FIG. 7 is a cross-sectional view along line B—B of FIG. 3. Elements identified with the same numerals as in other figures may be identical and will not be redundantly described. FIG. 7 illustrates the flow of ink 92 from the ink chamber 61 within print cartridge 18 to ink ejection chambers 94. Energization of the ink ejection elements 96 and 98 cause a droplet of ink 101, 102 to be ejected through the associated nozzles 82. A photoresist barrier layer 104, the flexible tape 80 and substrate 88 define the ink channels 90 and chambers 94. The conductor portion of the flexible tape 80 is glued with adhesive 108 to the plastic print cartridge body 110. Filter carrier 200 and filter 202 will be described in detail below with respect to FIGS. 9–13.

The plastic print cartridge body 110 is formed such that the ink conduit 63 directs the flow of ink from an ink chamber within the print cartridge 10 towards the back of the substrate 88 and through a narrow gap that exists between the back of the substrate 88 and the walls 162 and 163. The gap at the end of ink conduit 63 is much narrower than the gap between the ink conduit 54 and substrate 88 in prior print cartridges. The filter carrier 200 and the walls 162 and 163 direct the flow of ink 92 through the ink conduit 63. The walls 162 and 163 of the ink conduit 63 terminate approximately 0.127 mm (5 mils) from the back of the substrate 88, thereby forming the narrow gap. An acceptable range for this gap is from about 3 mils to about 12 mils, depending on the ink viscosity and flow rates. The distance, in the preferred embodiment, between walls 162 and 163 is approximately 1 mm. The distance between walls 162 and 163 may be anywhere between about 1 mm and 5 mm. Other distances may also be suitable depending upon the size of substrate 88, ink viscosity, and flow rates. The thickness of walls 162 and 163 is about 0.5 mm, but thinner walls will also work. The lower limit is dependent more on manufacturing tolerances than on thermal performance of the device. Walls thicker than 0.5 mm will also work. Thicker walls will have better thermal performance, but also worse pressure drop and bubble tolerance.

Although the same volume of ink is ejected from nozzles 82 as previous print cartridges, the ink velocity across the back of substrate 88 is much higher due to the narrower gap that exits at the end of ink conduit 63 relative to the large area available for flow everywhere in ink conduit 63. The increased ink velocity caused by the proximity of the ends of walls 162 and 163 to the back of substrate 88 cause a relatively large transfer of heat from the back of substrate 88 to the moving ink. The heated ink flows around the edges of substrate 88 and into the ink ejection chambers 94.

As the ink heats up, the solubility of air in the ink decreases, and air defuses out of the ink in the form of bubbles 112. In order for these bubbles 112 to not restrict the flow of ink, bubble accumulation chambers 168 and 170 are formed in the print cartridge body to accumulate these bubbles. Bubble accumulation chambers 168 and 170 are defined and formed both by the filter carrier 200 and the walls 162, 163. Hence, bubbles 112 will not interfere with the flow of ink through ink conduit 63 and around the edges of substrate 88 to the ink ejection chambers 94. In the preferred embodiment, these chambers 168 and 170 each have a capacity of 2 to 3 cubic centimeters; however, the capacity can be greater than or less than this preferred volume depending on the anticipated out gassing. An acceptable range is approximately 1 to 5 cubic centimeters. Chambers 168 and 170 extend along the length of substrate 88 to be in fluid communication with all the ink channels 90 formed in barrier layer 104 on substrate 88.

Figure 8:
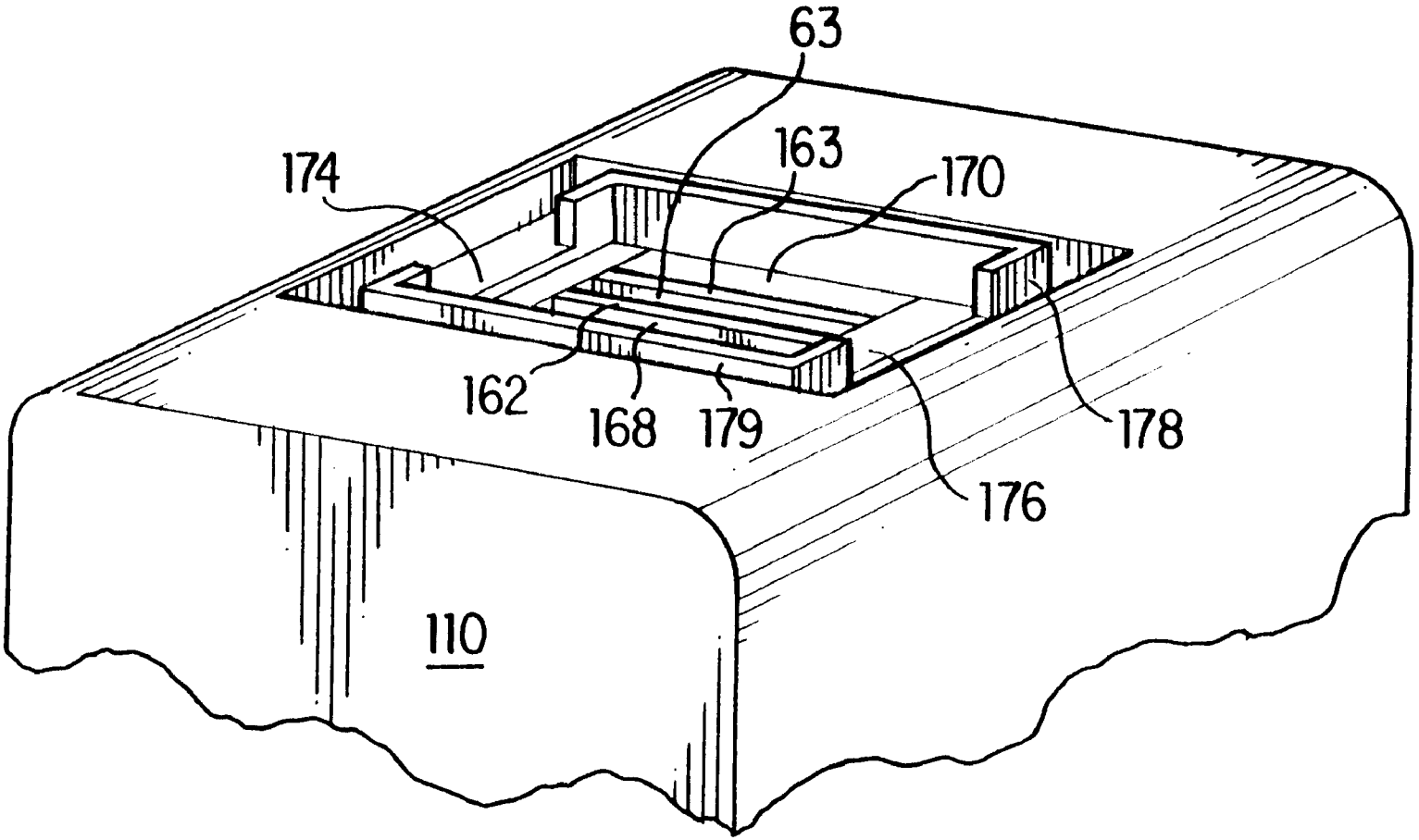
FIG. 8 is a perspective view the of print cartridge of FIG. 3 showing the headland area where the substrate and flex tape is attached.

FIG. 8 is perspective view of the print cartridge 18 with the tape 80 removed along with substrate 88 to reveal walls 162 and 163, ink conduit 63, and chambers 168 and 170. In one embodiment, the preferred length of substrate 88 is approximately one-half inch so that the lengths of walls 162 and 163 are slightly less than one-half inch.

An adhesive/sealant is applied to headland areas 174 and 176, and the assembly of FIG. 7 is then secured to the print cartridge 18 as shown in FIG. 3. The adhesive/sealant at areas 174 and 176 squishes upward to secure the ends of the substrate 881 to the print cartridge body and insulate the conductive traces on the back of tape 80 so that they will not be shorted by any ink in the vicinity of the conductors. An adhesive/sealant along the top of headland walls 178 and 179 secures the tape 80 to the print cartridge body.

Figure 9:
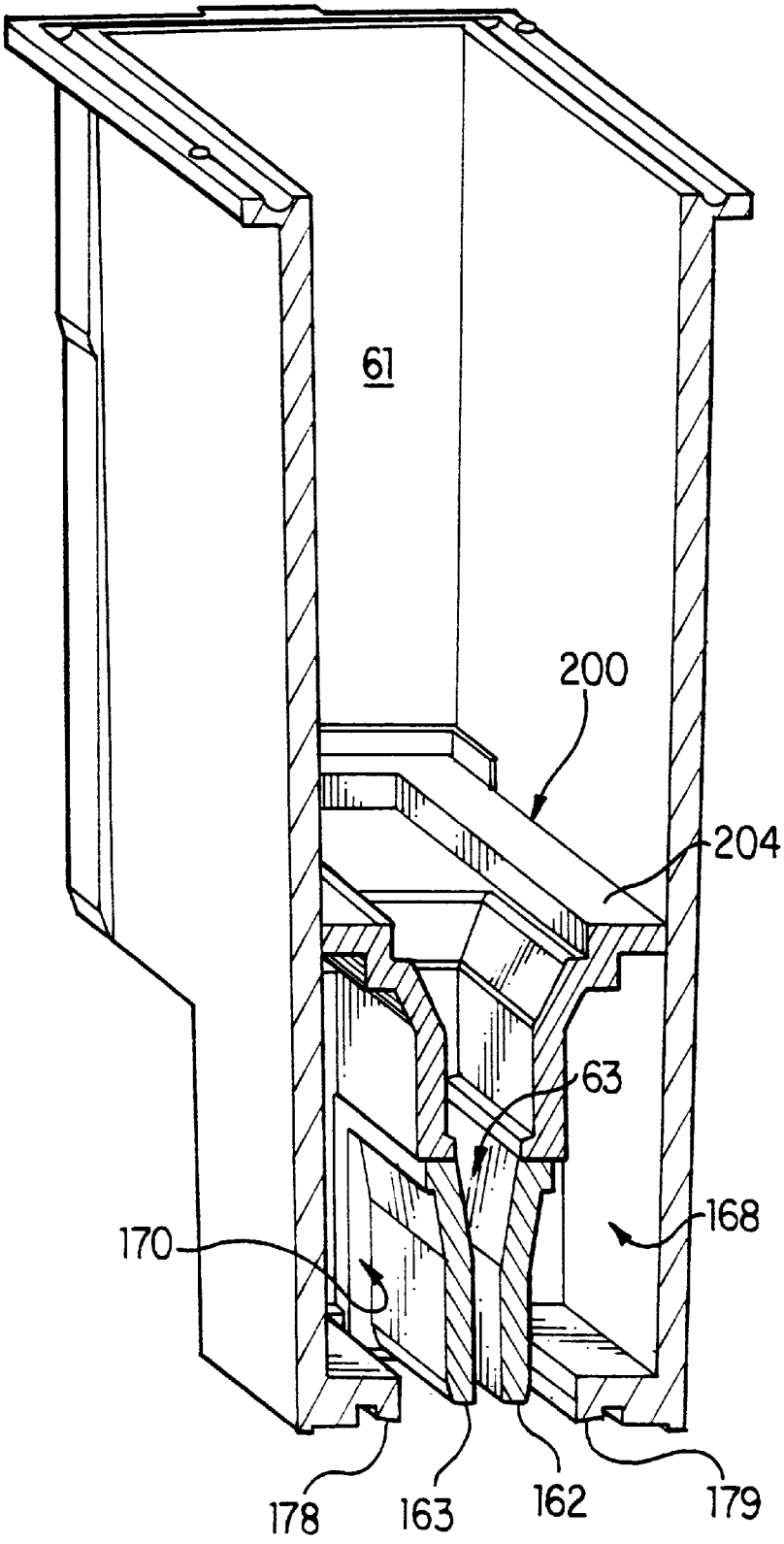
FIG. 9 is a cross-sectional, perspective view along line B—B of FIG. 3 illustrating an ink chamber for containing a pressure regulator, the filter carrier of the present invention and the ink conduit leading to the back surface of the substrate.

FIG. 9 is a cross-sectional, perspective view of the print cartridge of FIG. 3 with tape 80 removed along line B—B of FIG. 3 illustrating an ink chamber 61 for containing ink and a pressure regulator, the filter carrier 200 (with filter screen 202 removed) described in detail below, walls 162 and 163, the ink conduit 63 (defined by the filter carrier 200 and walls 162, 163) leading to the back surface of the substrate 88 and bubble accumulation chambers 168 and 170 defined and formed both by the filter carrier 200 and the walls 162, 163.

Inkjet printheads are very sensitive to particulate contamination. To deal with this problem, a filter is required between the reservoir of ink 61 and the printhead 58. The filter prevents particulate contaminates from flowing from the ink reservoir 61 to the printhead 58 and clogging the printhead nozzles 82. Also, the filter prevents air bubbles from traveling from the printhead 58 into the reservoir 61. The filter separates the ink conduit 63 of the housing into two regions: (1) one upstream and in fluid communication with the reservoir 61 and (2) one downstream of the filter and in fluid communication with the printhead.

The external body 110 tends to be selected and molded from a relatively rigid engineering plastic for structural rigidity and high heat deflection. Fillers (such as glass fibers) are typically included to enhance these properties. Such materials tend to be difficult surfaces to which to attach a filter and effect a complete seal around the perimeter of the filter. If the seal is not complete, bubbles or particulates may slip past the filter and block the ink channels or nozzles. The separation of the filter staking from the cartridge housing provides more freedom of material selection for both the cartridge housing material and a good heat staking material for the filter carrier. Moreover, the filter staking process is greatly simplified when it can be performed external to the cartridge housing. These difficulties are further compounded by the new design described above which provides a jet impinging flow of ink to cool the printhead. This design makes the molding of the rigid housing with walls 162, 163 very difficult.

The present invention provides a way to reduce the dependency of the filter attach properties upon the selection of exterior housing properties without adding a costly insertion molding process. Further, there is a need to provide a housing and filter design that makes the jet impinging flow design easier to mold. There is also a need for a way to provide a variable volume for the storage of out gassed air for the same print cartridge housing.

Figure 10:
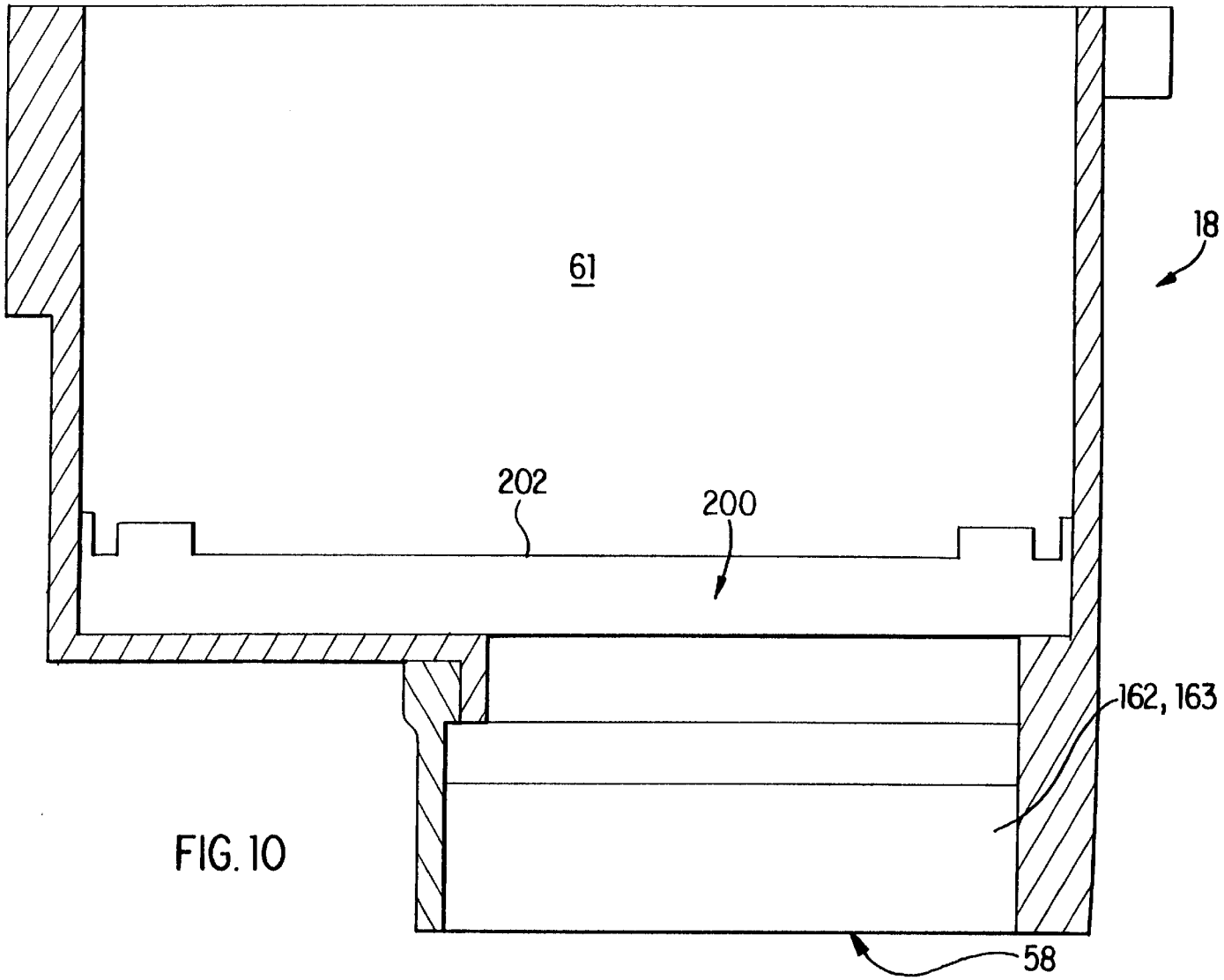
FIG. 10 is a cross-sectional view along line A—A of FIG. 5 illustrating the location of the filter carrier of the present invention in the print cartridge.

FIG. 10 is a cross-sectional view along line A—A of FIG. 5 illustrating the location of the filter carrier 200 of the present invention in the print cartridge 18. Filter carrier 200 is supported in cartridge 18 by support surfaces 190, 192. Filter carrier 200 is also supported walls 162, 163 which were described above. The position of the filter screen 202 is also shown.

Figure 11:
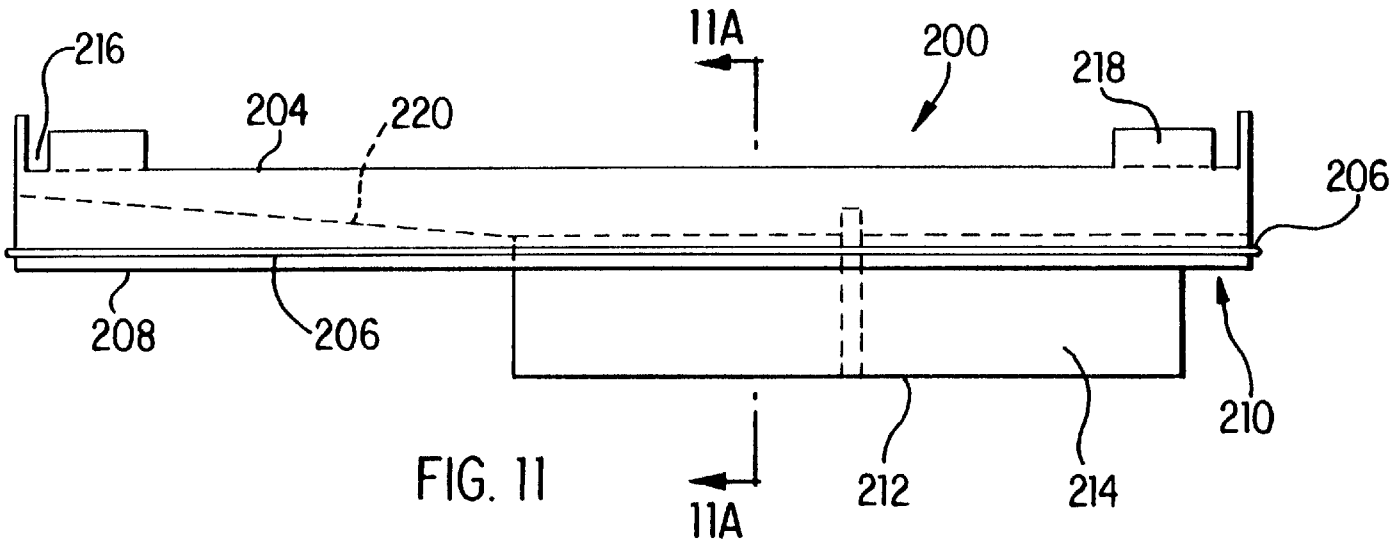
FIG. 11 is a side elevational view of the filter carrier of the present invention.
Figure 11A:
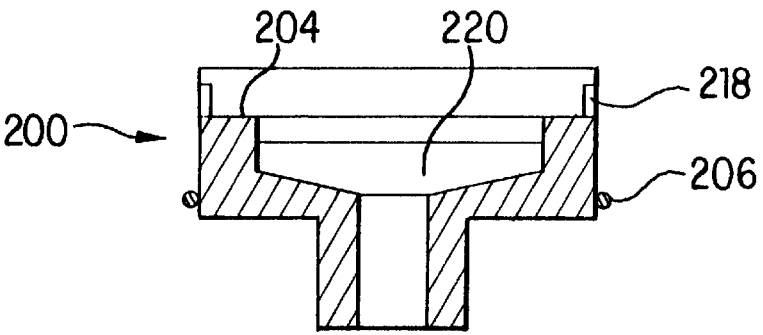
FIG. 11A is a cross-sectional view along line A—A of FIG. 11.
Figure 12:
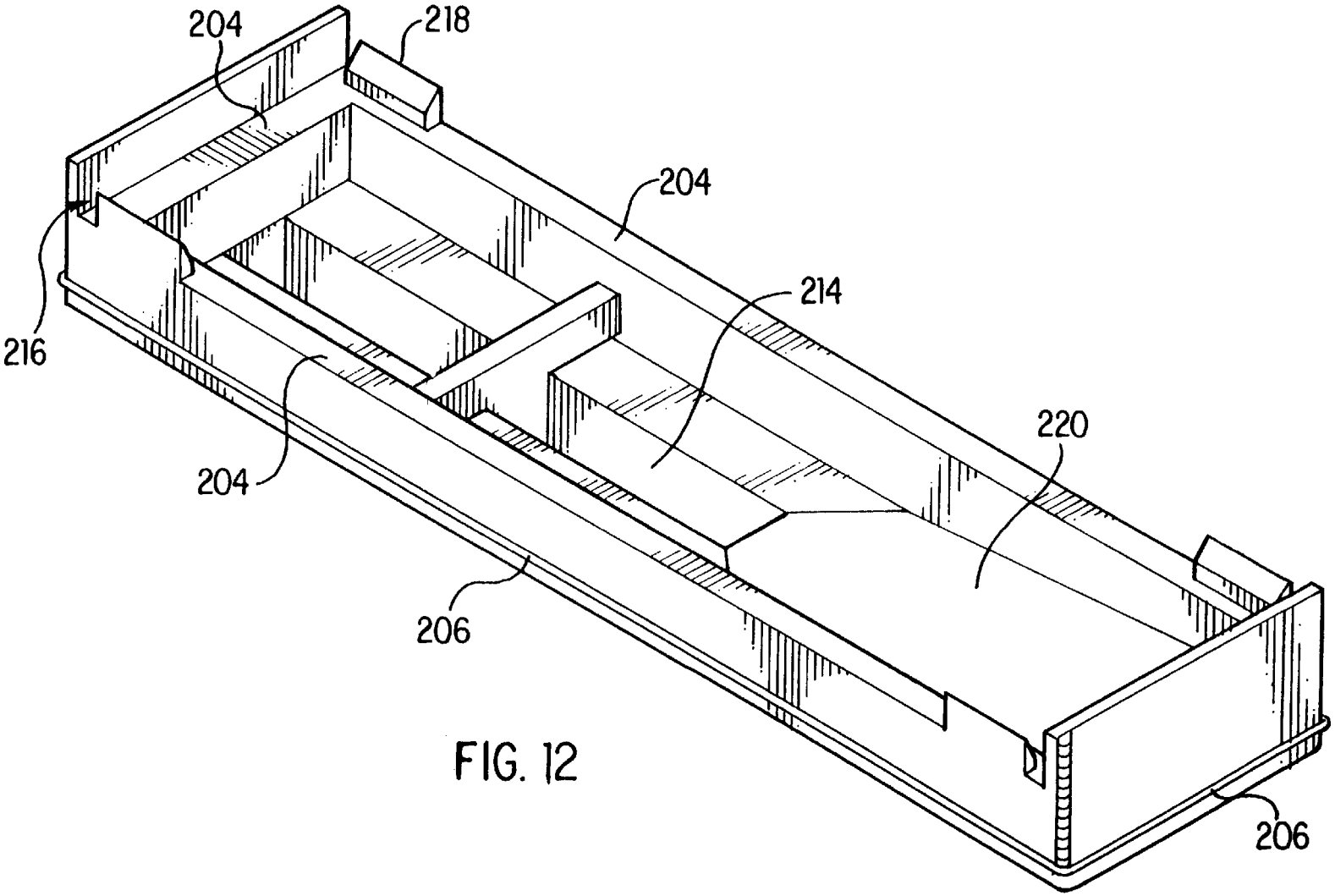
FIG. 12 is a perspective view looking at the top of the filter carrier of the present invention.
Figure 13:
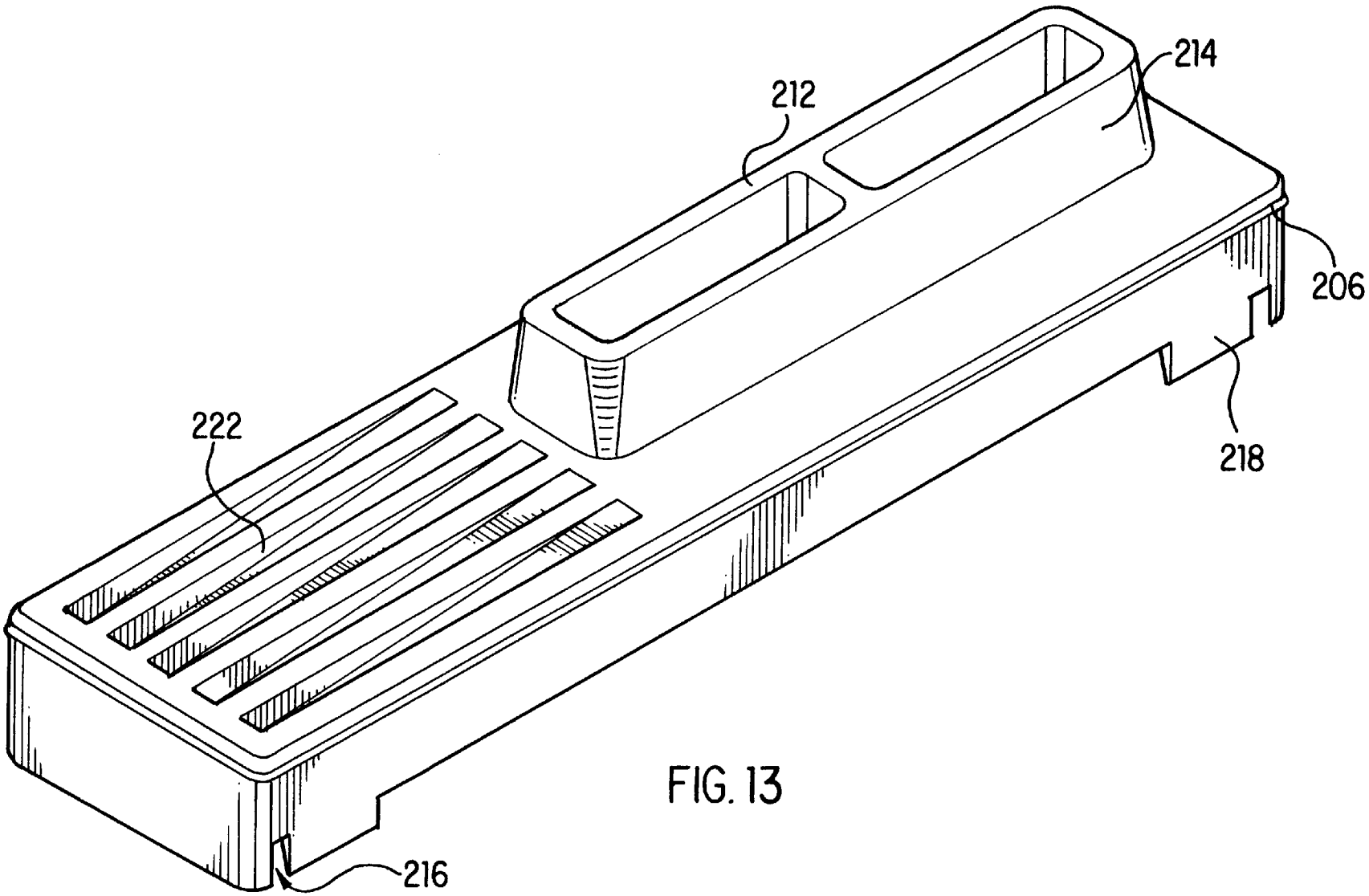
FIG. 13 is a perspective view looking at the bottom of the filter carrier of the present invention.
Figure 14:
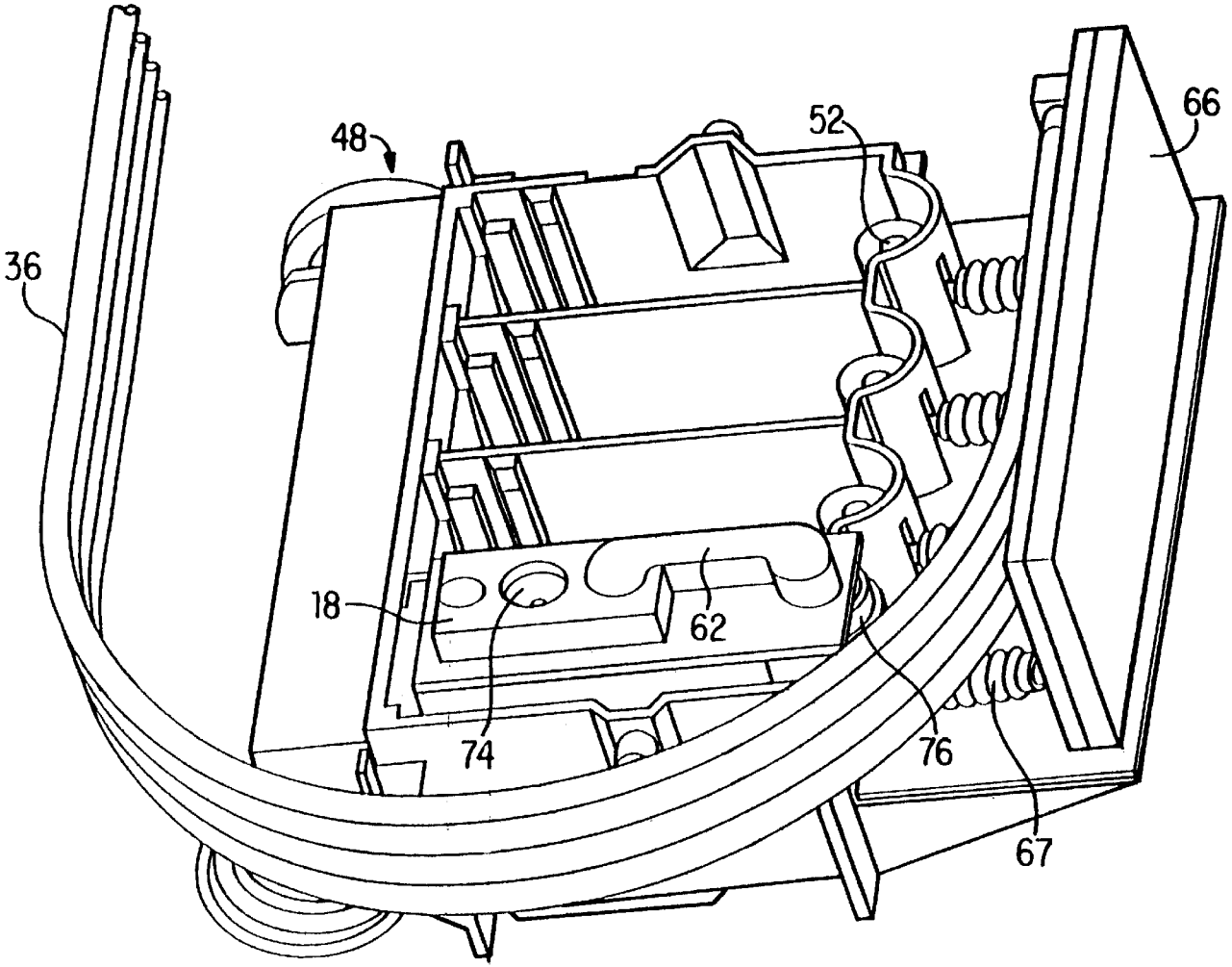
FIG. 14 is a perspective view looking down on the carriage of the printer shown in FIG. 2 with one print cartridge installed.

Referring to FIGS. 11 through 13, filter screen 202 is attached to the top surface 204 of filter carrier 200 through heat staking (heat and pressure welding), adhesives or other bonding processes, to form a leak-proof seal between the filter screen 202 and filter carrier 200. The filter carrier 200 is made of a plastic such polypropylene or high density polyethylene, or other suitable material.

Filter screen 202 is attached to the top surface 204 of filter carrier 200 through preferably heat staking (heat and pressure welding), or alternatively, adhesives or other bonding processes, to form a leak-proof seal between the filter screen 202 and filter carrier 200. The filter screen 202 is formed of a material which is permeable to the ink to be stored within the ink reservoir, and compatible with the plastic of material from which the filter carrier 200 is fabricated. A preferred material for the filter screen 202 is a section of finely woven stainless steel mesh, the periphery edges of which are attached to the top surface 204 of filter carrier 200 by heat staking. The mesh has a nominal passage dimension of 15 microns between adjacent mesh strands, and has a typical thickness of less than 0.005 inches.

The filter carrier 200 is inserted into the cartridge body 110 such that the bottom surfaces 208, 210 of filter carrier 200 rest on cartridge body surfaces 190, 192, respectively, and bottom surface 212 of the snout portion 214 of filter carrier 200 rests on the top surface cartridge body walls 162, 163. The seal between the bottom surface 212 of the snout portion 214 of filter carrier 200 and the walls 162, 163 is a face seal. The inside of the filter carrier 200 has square corners for ink to wick up in the event that air fills the filter standpipe. The manufacture of the square corners is facilitated by slits 216. Tabs 218 hold filter screen 202 in place during the heat staking process to filter carrier 200. The sloping surface 220 of filter carrier 200 helps prevent trapping of air during the cartridge filling process. Grooves 222 are provided to prevent distortion during the molding process for filter carrier 200.

The filter carrier 200 has a carrier seal 206 on all sides to engage a housing seal surface disposed on the inside walls of the housing 110 to define a seal zone that separates chamber 61 from the region in fluid communication with printhead and make a leak proof seal around the filter carrier 200 and the cartridge body 110. The carrier seal 206 is adapted to deform upon installation of the filter carrier 200 in the housing 110 and provide a reliable seal.

Another problem that occurs during the life of the print element is air out gassing. Air builds up between the filter and the printhead during operation of the printhead. For printers that have a high use model, it would be preferable to have a larger volume between the filter and the printhead for the storage of air. For low use rate printers, this volume would be reduced. The present invention also addresses this problem. The filter carrier 200 height can be adjusted to readily provide varying volumes for chambers 168, 170 depending on the anticipated out-gassing.

The mesh passage size is sufficiently small that while ink may pass through the passages of the mesh, air bubbles under normal atmospheric pressure will not pass through the mesh passages which are wetted by the ink. The required air bubble pressure necessary to permit bubbles to pass through the mesh, in this embodiment, about 30 inches of water, is well above that experienced by the pen under any typical storage, handling or operational conditions. As a result, the mesh also serves the function of an air check valve for the print cartridge.

FIG. 13 is a perspective view of carriage 16 looking down on carriage 16. Ink is provided to carriage 16 by tubes 36 which connect to a plastic manifold 66. Tubes 36 may be formed of Polyvinylidene Chloride (PVDC), such as Saran™, or other suitable plastic. Manifold 66 provides several 90° redirections of ink flow. Such a manifold 66 may not be needed if tubes 36 are sufficiently slender and can be bent without buckling.

A septum elbow 71 routes ink from manifold 66 to septum 52 and supports septum 52. A bellows 67 (shown in cross-section) is provided for each of the individual stalls 68 for allowing a degree of x, y, and z movement of septum 52 when needle 60 is inserted into septum 52 to minimize the x, y, and z load on needle 60 and ensure a fluid-tight and air-tight seal around needle 60. Bellows 67 may be formed of butyl rubber, high acn nitrile, or other flexible material with low vapor and air transmission properties. Bellow 67 can be any length and can even be a flexible diaphragm.

A spring 70 urges septum 52 upward. This allows septum 52 to take up z tolerances, minimizes the load on needle 60, and ensures a tight seal around needle 60. Slots 72 formed on each of the stalls 68 in carriage 16 align with tabs on each print cartridge 18 to restrict movement of the print cartridge 18 within the stall 68. An air vent 74 formed in the top of print cartridge 18 is used by a pressure regulator in print cartridge 18, to be described later. In an alternative embodiment, a separate regulator may be connected between the off-axis ink supply and each print cartridge 18. In other embodiments bellows 67 may replaced with a U-shaped, circular, or straight flexible tube.

An opening in the bottom of the carriage 16 exposes the printhead location 58 of each print cartridge 18. Carriage electrodes (not shown) oppose contact pads 86 (shown in FIG. 3) located on print cartridges 18. Carriage electrodes are connected via an electrical flex circuit (not shown) to the printer's microprocessor which sends signals to control ink ejection. In an alternative embodiment the electrical flex circuit is connected directly to the print cartridges 18 by either electrical connectors or by being permanent soldering thereby eliminating the need and complexity of providing make/break connections on the carriage 16.

The print cartridges 18 can be secured within the scanning carriage 16, by a latch, which may be manually operated or spring loaded, where the latch presses down on a tab or a corner of the print cartridge 18. In another embodiment, a single latch, such as a hinged bar, secures the print cartridge 18 in place within the carriage 16.

Other embodiments of scanning carriages and print cartridges are described in U.S. patent application Ser. No. 08/706,121, filed Aug. 30, 1996, now U.S. Pat. No. 5,966,155 entitled "Inkjet Printing System with Off-Axis ink Supply Having ink Path Which Does Not Extend above Print Cartridge," Attorney Docket No. 10960734, which is herein incorporated by reference.

The ink within each of the off-axis ink supply cartridges 31–34 may be at atmospheric pressure, whereby ink is drawn into each of print cartridges 18 by a negative pressure within each print cartridge determined by a regulator internal to each print cartridge as discussed above. Alternatively, the off-axis ink supply cartridges may be pressurized. In either the unpressurized or pressurized ink supply embodiments, a pressure regulator is used within the print cartridge for regulating the pressure of the ink chamber within the print cartridge. One embodiment of a pressure regulator is described in U.S. patent application Ser. No. 08/706,121, filed Aug. 30, 1996, now U.S. Pat. No. 5,966,155 entitled "Inkjet Printing System with Off-Axis ink Supply Having ink Path Which Does Not Extend above Print Cartridge," which is herein incorporated by reference.

Figure 2:
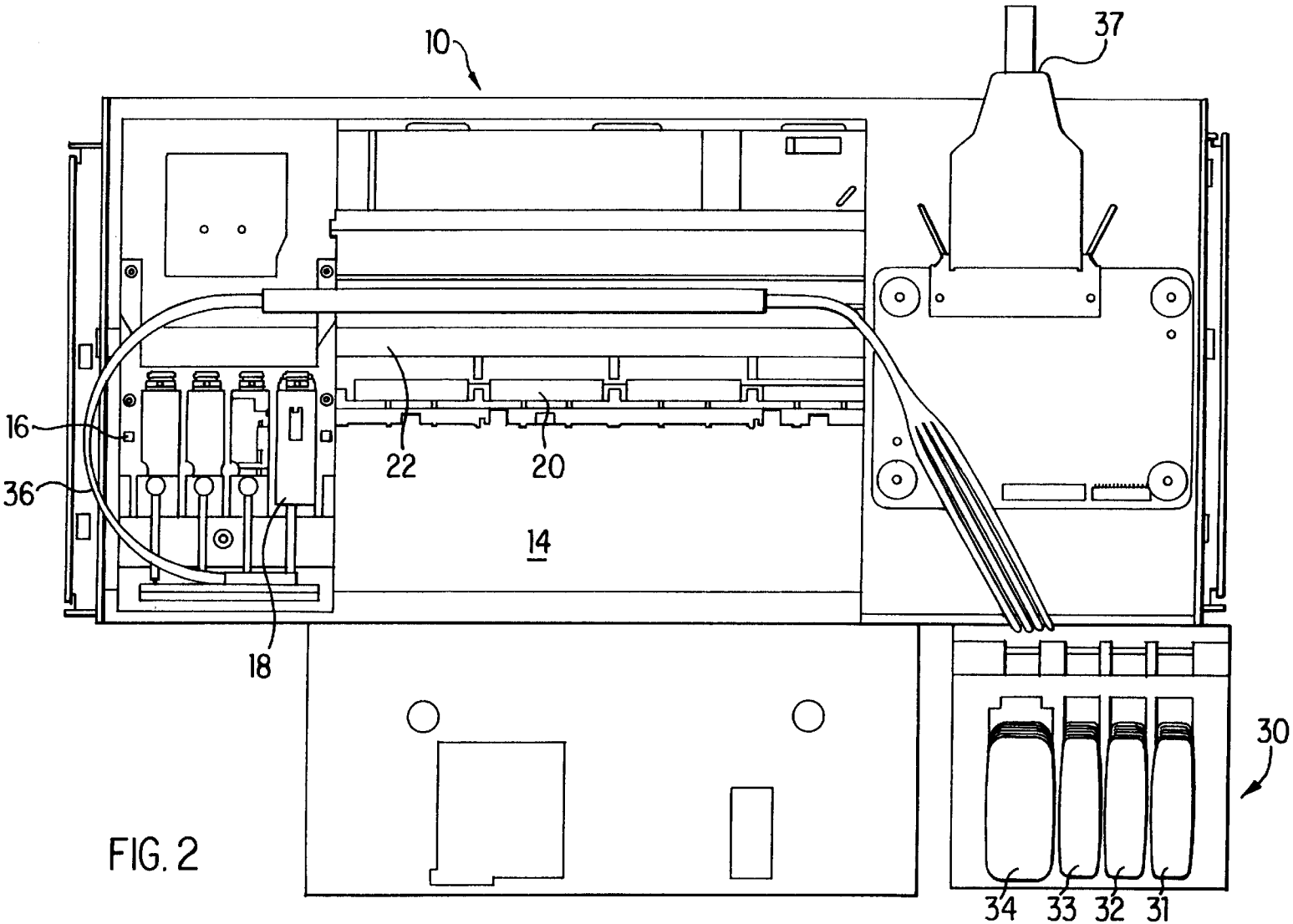
FIG. 2 is a simplified, partial top view of another embodiment of an inkjet printer incorporating the present invention, but illustrating a different routing of the ink supply tubes from the off-axis ink reservoirs to the carriage-mounted ink cartridges.

As a result of these design options, the filter carrier assembly offers a wide range of product implementations other than those illustrated in FIGS. 1 and 2. For example, such printhead assembly systems may be incorporated into an inkjet printer used in a facsimile machine, a copying machine, which may also be a combined facsimile/copying machine and large-format printers which print on a wide, continuous paper roll.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. A print cartridge for an inkjet printhead, comprising an outer housing;

a filter carrier disposed within the outer housing, wherein the filter carrier is a modular component that is formed prior to installation of the filter carrier into the outer housing;

a filter disposed on the filter carrier, wherein the filter carrier divides the housing into an upper section and a lower section to define an ink flow path from the upper section through the filter to the lower section;

inner walls within the print cartridge; and a bubble accumulation chamber defined by the inner walls and the filter carrier, wherein the filter carrier further comprises a seal that deformably adapts to the inner walls to provide a reliable seal and wherein the filter carrier is adjustable within a height area of the print cartridge to vary the volume of the bubble accumulation chamber.

2. The print cartridge of claim 1, wherein the print cartridge has an ink chamber for holding a supply of liquid ink.

3. The print cartridge of claim 5, further comprising a printhead on the print cartridge, the printhead having a substrate which defines a plurality of ink ejection chambers and wherein the upper portion forms the ink chamber and the lower portion connects the ink chamber with the ejection chambers.

4. The print cartridge of claim 1, further comprising an external ink supply in fluid communication with the ink chamber.

5. A method of delivering ink, comprising:

attaching a filter to a filter carrier;

dividing a housing of a print cartridge into an upper section and a lower section by the filter carrier to provide an ink flow path, wherein ink flows from the upper section through the filter to the lower section;

adjusting the filter carrier within a height area of the print cartridge to change the volume of the lower portion; and moving the ink from the upper portion through the filter carrier.

6. The method of claim 5, further comprising:

providing a printhead having a substrate on which is formed ink ejection chambers;

providing an ink chamber;

providing fluid communication between the ink ejection chambers and the ink chamber along an ink flow path; and mounting the printhead to the housing.

7. The method of claim 6, further comprising transporting the ink from the ink chamber through the filter to the ink ejection chambers.

8. The method of claim 6, further comprising supplying ink to the ink chamber by refilling the ink chamber after the ink chamber has been depleted of ink with an external ink supply in fluid communication with the ink chamber.

9. The method of claim 8, further comprising providing a carriage capable of displacing the printhead, wherein the external ink supply is located on the carriage.

10. The method of claim 5, wherein attaching the filter to the filter carrier forms a separate modular component.

* * * * *

UNITED STATES PATENT AND TRADEMARK OFFICE

CERTIFICATE OF CORRECTION

PATENT NO. : 6,234,622 B1
DATED : May 22, 2001
INVENTOR(S) : Liu et al.

It is certified that error appears in the above-identified patent and that said Letters Patent is hereby corrected as shown below:

Title page, Item [57],
Abstract, line 12, delete "sing" and insert in lieu thereof staking Signed and Sealed this Thirtieth Day of October, 2001

*Attest:*

Nicholas P. Godici

NICHOLAS P. GODICI
*Acting Director of the United States Patent and Trademark Office*

*Attesting Officer*